US010413919B2

(12) United States Patent
Chevron et al.

(10) Patent No.: US 10,413,919 B2
(45) Date of Patent: Sep. 17, 2019

(54) ELECTROSTATIC SPRAYER OF COATING PRODUCT AND PROJECTION ASSEMBLY COMPRISING SUCH A SPRAYER

(71) Applicant: SAMES TECHNOLOGIES, Meylan (FR)

(72) Inventors: Didier Chevron, Moirans (FR); Eric Prus, Grenoble (FR)

(73) Assignee: SAMES KREMLIN, Meylan (FR)

( * ) Notice: Subject to any disclaimer, the term of this patent is extended or adjusted under 35 U.S.C. 154(b) by 0 days.

(21) Appl. No.: 15/034,755

(22) PCT Filed: Nov. 12, 2014

(86) PCT No.: PCT/EP2014/074343

§ 371 (c)(1),
(2) Date: May 5, 2016

(87) PCT Pub. No.: WO2015/071291

PCT Pub. Date: May 21, 2015

(65) Prior Publication Data

US 2016/0271631 A1 Sep. 22, 2016

(30) Foreign Application Priority Data

Nov. 12, 2013 (FR) ..... 13 61039

(51) Int. Cl.
*B05B 5/053* (2006.01)
*B05B 5/04* (2006.01)
(Continued)

(52) U.S. Cl.
CPC ..... *B05B 5/0533* (2013.01); *B05B 5/0403* (2013.01); *B05B 5/0407* (2013.01); *B05B 5/087* (2013.01); *B05B 15/50* (2018.02)

(58) Field of Classification Search
CPC ..... B05B 5/0403; B05B 5/0407; B05B 5/087; B05B 5/0536; B05B 5/0535; B05B 5/0533; B05B 15/02; B05B 15/50; B05B 5/0426
(Continued)

(56) References Cited

U.S. PATENT DOCUMENTS 2,960,273 A * 11/1960 Croskey ..... B05B 5/03 118/300
2,996,042 A * 8/1961 Juvinall ..... B05B 3/1064 118/624
(Continued)

FOREIGN PATENT DOCUMENTS

CN 1292731 A 4/2001
CN 100512976 C 7/2009
(Continued)

OTHER PUBLICATIONS

French Search Report for FR 1361039 dated Jun. 25, 2014.
International Search Report for PCT/EP2014/074343 dated Feb. 13, 2015.

*Primary Examiner* — Viet Le
*Assistant Examiner* — Christopher R Dandridge
(74) *Attorney, Agent, or Firm* — Pearne & Gordon LLP

(57) ABSTRACT

This electrostatic sprayer of coating products with external load, comprises a bowl rotatable about an axis, a turbine for rotating the bowl around this axis, and a plurality of first electrodes distributed around the axis and each capable of emitting, when the sprayer is operating and is at least partly in the direction on an object to be coated, a first ion flux from a first point. The first points are arranged in a first circle centered on and perpendicular to the axis. The sprayer comprises second electrodes each capable of emitting, when the sprayer is operating and mainly or exclusively in the direction of an edge of the bowl, a second ion flux, of the
(Continued)

same sign as the first ion flux, from second points arranged in a second circle centered on and perpendicular to the axis, and having a different radius than the first circle.

16 Claims, 8 Drawing Sheets

(51) Int. Cl.
*B05B 5/08* (2006.01)
*B05B 15/50* (2018.01)

(58) Field of Classification Search
USPC ..... 239/690–704
See application file for complete search history.

(56) References Cited

U.S. PATENT DOCUMENTS 3,408,985 A * 11/1968 Sedlacsik ..... B05B 5/03 118/629
4,572,438 A * 2/1986 Traylor ..... B05B 5/0536 239/600
4,579,279 A 4/1986 Marchant
4,887,770 A * 12/1989 Wacker ..... B05B 5/04 239/703
6,659,367 B2 12/2003 Ballu
6,708,908 B2 * 3/2004 Heldt ..... B05B 5/04 239/690
7,070,130 B1 * 7/2006 Minko ..... B05B 5/0533 239/222.11
7,452,421 B2 11/2008 Thome
9,452,451 B2 9/2016 Kleiner
2003/0001031 A1 * 1/2003 Heldt ..... B05B 5/04 239/700
2008/0178802 A1 * 7/2008 Sakakibara ..... B05B 5/0533 118/621

FOREIGN PATENT DOCUMENTS

CN 101878070 A 11/2010
CN 102333599 A 1/2012
CN 103328112 A 9/2013
EP 1480756 A1 12/2004
EP 1800757 A1 6/2007
EP 2213378 A1 8/2010
EP 2401090 B1 4/2015
FR 1223451 * 6/1960 ..... B05B 5/0533
JP H041662 A 1/1992
JP H06-7709 A 1/1994
JP H-06-320065 A 11/1994
KR 101238735 B1 3/2013

* cited by examiner

ELECTROSTATIC SPRAYER OF COATING PRODUCT AND PROJECTION ASSEMBLY COMPRISING SUCH A SPRAYER

This is a National Stage application of PCT international application PCT/EP2014/074343, filed on Nov. 12, 2014 which claims the priority of French Patent Application No. 1361039 entitled "ELECTROSTATIC SPRAYER OF COATING PRODUCT AND PROJECTION ASSEMBLY COMPRISING SUCH A SPRAYER", filed Nov. 12, 2013, both of which are incorporated herein by reference in their entirety.

The invention relates to an electrostatic sprayer for a coating product that comprises, inter alia, a rotating bowl and several electrodes distributed around the rotation axis of the bowl.

In the field of the electrostatic spraying of coating products, it is known to use an electrostatic field to improve the deposition performance on the objects to be coated.

In the case of a so-called "internal" or "contact" charge, the coating product comes into contact with an electrode brought to a non-zero electric potential, such that each droplet or particle of coating product sprayed is assigned an electrostatic charge q when it detaches from the rim of the rotating bowl. When such a droplet or particle thus charged is subjected to an electrostatic field, it undergoes a Coulomb force proportional to its charge and the intensity of this field. One drawback of this charge mode results from the fact that, if the coating product is conductive, which is in particular the case for hydrosoluble coating products, it is necessary to isolate the sprayer brought to the high voltage from its supply system for supplying coating product that is at the earth potential. To do that, it is known, for example from EP-A-0,274,322, to use one or more reservoirs onboard a multiaxial robot. This approach is generally satisfactory, but yields a relatively complex coating product spraying installation.

In the case of a so-called "external" or "Corona effect" charge, the droplets or particles of coating product that leave the edge of the rotating bowl pass in the vicinity of electrodes brought to a non-zero electric potential, such that they encounter ions bombarded by these electrodes and end up being electrostatically charged and attracted by the object to be coated, which is at the earth potential. This charging mode makes it possible to keep the coating product at the earth potential for spraying, without risk of short-circuiting the high-voltage generator. It is, however, very sensitive to dirtying of the electrodes. In particular, the charging phenomenon used to direct the droplets or particles toward the object to be coated depends on the creation of an electric current between the electrodes and their environment, in particular the object to be coated and the bowl, by ionization of the air around the electrodes. One can also see that the droplets or particles that leave the bowl become charged via the influence with a sign opposite that of the electric potential applied to the electrode. For example, if the electrode is brought to a negative potential, the droplets or particles leaving the bowl are positively charged. Yet in some cases, an electrode may begin to become dirty, for example due to movements of the sprayer in directions perpendicular to the rotation axis of the bowl, such that the electrodes penetrate deeply in the cloud of coating product emitted by the bowl and are covered with product. The ionization current emitted by the electrodes may also decrease in intensity due to variations in the distance between the sprayer and the object to be coated or due to an obstacle or a cloud of already charged droplets forming a screen between these electrodes and this object. These phenomena are difficult to foresee and cause runaway of the dirtying and a sharp drop in the electrostatic charge of the cloud of coating product. Indeed, if the ionization current decreases, the droplets or particles which, upon leaving the bowl, are charged with a sign opposite that of the electrodes, are attracted by these electrodes and tend to be deposited thereon and on their mechanical supports. Runaway of the dirtying phenomenon then occurs and the particles that quickly cover the electrodes further decrease the ionization current, to the point that the charge by Corona effect is stopped. It is then necessary to interrupt production to clean the electrodes. This requires constant monitoring of the installation, since if an intervention does not occur quickly, the parts to be treated are not correctly coated and must be subject to a recovery procedure, which is both long and costly.

The invention more particularly aims to resolve these drawbacks by proposing a new electrostatic sprayer for coating product with external charging, with a reliabilized operation.

To that end, the invention relates to an electrostatic sprayer for coating products with an external charge comprising a bowl rotating around a rotation axis, means for driving the rotation of the bowl around this axis, several first electrodes distributed around this axis and each able to emit, when the sprayer is operating and at least partially toward an object to be coated, a first stream of ions from a first tip, the first tips being fitted into a first circle centered on the rotation axis and perpendicular thereto. According to the invention, the sprayer comprises second electrodes each able to emit, when the sprayer is operating and primarily or exclusively toward the edge of the bowl, a second stream of ions, with the same sign as the ions of the first ion streams, from second tips fitted into a second circle centered on the rotation axis, perpendicular thereto and the radius of which is different from that of the first circle. Furthermore, each second tip is positioned, in a plane radial to the rotation axis, in a dihedron, the origin of which is on an axis extending a first electrode toward the rear, the apical angle of which is equal to 90° and which is centered on an axis oriented toward the edge of the bowl.

Owing to the invention, the second electrodes makes it possible to create, using the second stream of ions, an electrostatic field between their tips and the bowl, this electrostatic field being less influenced by outside phenomena, whether aeraulic or electrostatic, that the new electrostatic field has created between the first electrodes and the object to be coated. In other words, the ionization phenomenon that exists in the vicinity of the second electrodes is more constant than that which exists in the vicinity of the first electrodes. Thus, the polarity of these droplets or particles is reversed due to their encounter with the ion current from the second electrodes, and as a result of this reversal and polarity, these droplets or particles are electrostatically pushed back by the first and second electrodes, which have a lower risk of becoming dirty than in the known external charging installations.

According to advantageous but optional aspects of the invention, such a sprayer may incorporate one or more of the following features, considered in any technically allowable combination:

- The radius of the second circle is smaller than the radius of the first circle.
- The second tips are offset, along the rotation axis and toward the rear of the sprayer, relative to the first tips.

Each second tip is oriented globally toward the edge of the bowl.

Each second tip is positioned, in a plane transverse to the axis of rotation, in a dihedron whereof the origin is combined with the projection of the tip of a first electrode, the apical angle of which is equal to 120°, and which is centered on a radial axis relative to the rotation axis, preferably in a dihedron with the same origin and centered on the same line whereof the apical angle is equal to 90°.

In a plane radial to the rotation axis, each second tip is positioned on the central axis of the dihedron in which it is positioned and in a plane transverse to the rotation axis, each second tip is positioned on the central radial axis of the dihedron in which it is positioned.

The sprayer comprises several supports each bearing a first electrode and at least one second electrode.

The electrodes are rectilinear, the first electrode extends along a longitudinal axis of the support and the second electrode extends along an axis perpendicular to the longitudinal axis.

The sprayer comprises means for indexing the position of each support in rotation around its longitudinal axis.

The sprayer comprises a single second electrode in the vicinity of each first electrode, in particular on a same support.

The sprayer comprises several second electrodes in the vicinity of each first electrode, in particular on the same support.

The sprayer comprises third electrodes provided with third tips fitted into a third circle centered on the rotation axis and perpendicular thereto, the radius of which is different from those of the first and second circles, these third tips being oriented radially outward relative to the rotation axis.

The invention also relates to a spraying installation for a coating product that comprises at least one sprayer as described above.

The invention will be better understood and other advantages thereof will appear more clearly in light of the following description of four embodiments of a sprayer according to its principle, provided solely as an example and done in reference to the appended drawings, in which.

Figure 1:
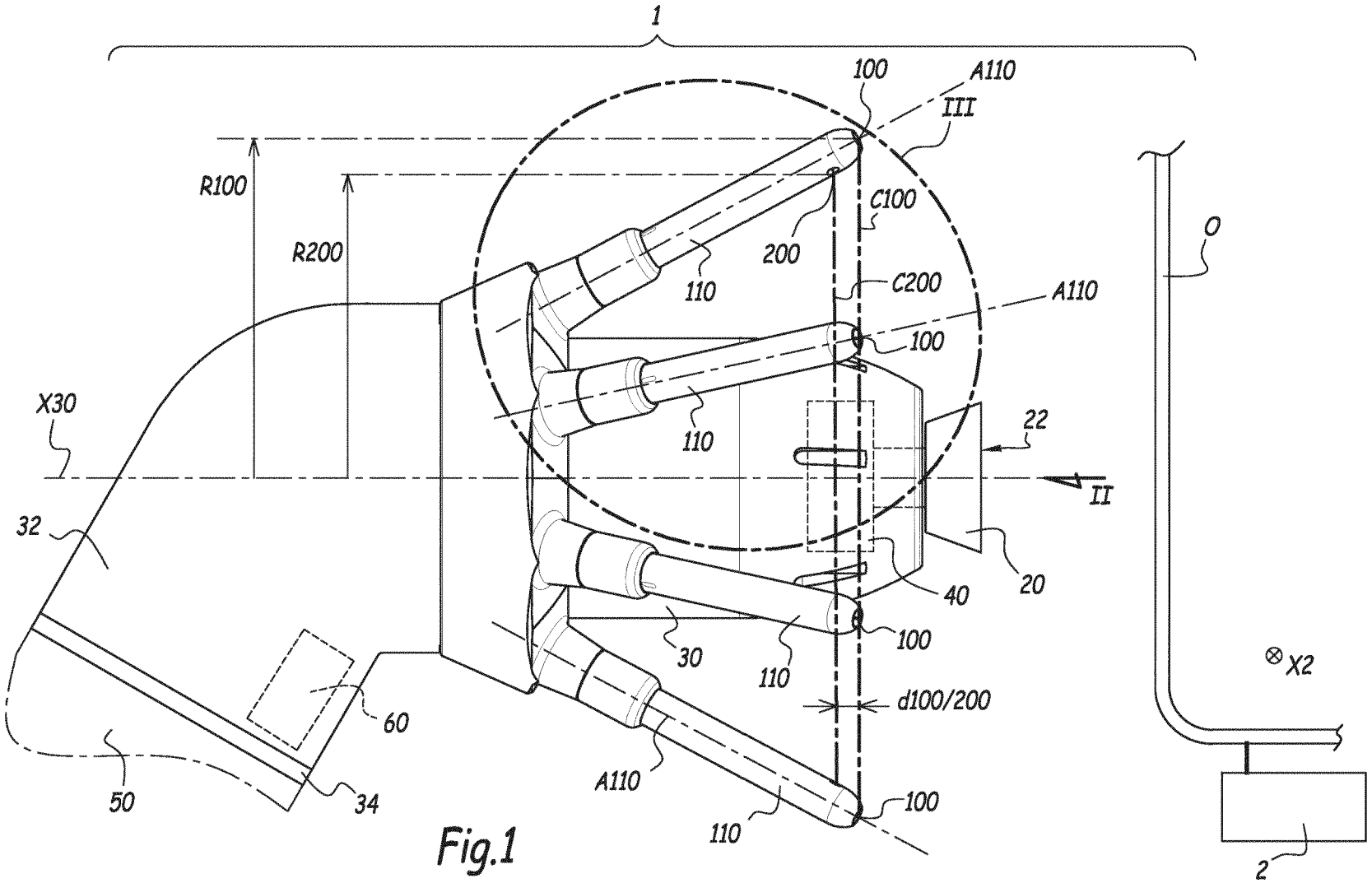
FIG. 1 is a diagrammatic block diagram of a spraying installation according to the invention incorporating an electrostatic sprayer according to the invention, seen from the side.
Figure 2:
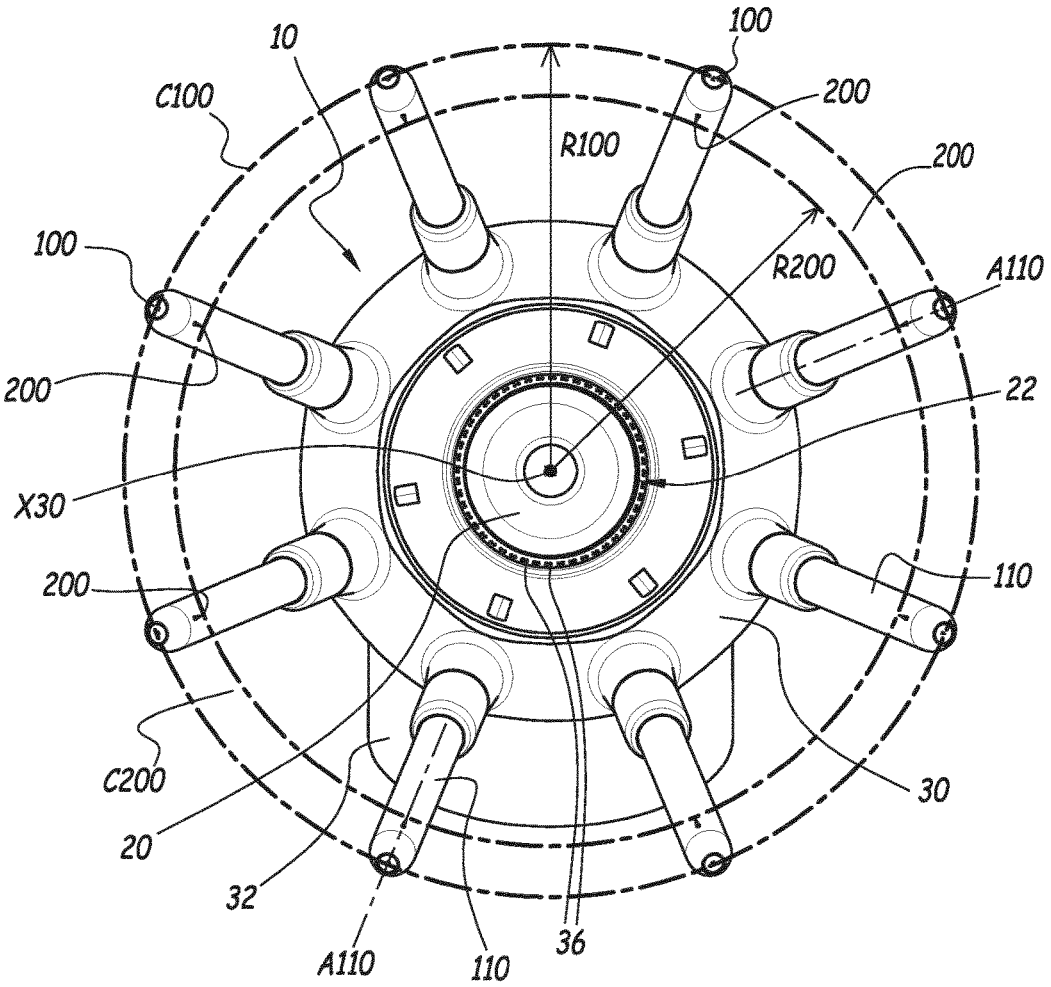
FIG. 2 is a front view of the sprayer shown in FIG. 1, in the direction of arrow II in FIG. 1.

The installation 1 illustrated in FIG. 1 comprises a conveyor 2 able to move objects O to be coated along an axis X2 perpendicular to the plane of FIG. 1. In the example of the figures, the object O moved by the conveyor 2 is a motor vehicle body that is partially illustrated.

The installation 1 also comprises a sprayer 10 of the rotating electrostatic type, which comprises a bowl 20 forming a member for spraying a liquid coating product and supported by a body 30 inside which a turbine 40 is mounted for driving the rotation of the bowl 20 around an axis X30 of the sprayer 10 that is defined by the body 30. The turbine 40 is shown in dotted lines in FIGS. 1, 3 and 4 by its rotor. The body 30 is bent and comprises a rear part 32 equipped with a platen 34 for mounting on a multiaxial robot arm 50 that is partially shown, in axis lines.

The front of the sprayer 10 is defined as its side turned toward the objects O to be coated. The rear of the sprayer 10 is defined as its side turned opposite these objects. Thus, the part 32 is oriented toward the rear of the sprayer 10. During operation of the installation 1, a front part of the sprayer is closer to the object O being coated than a rear part.

The body 30 also contains a high-voltage unit 60 that powers eight electrodes 100 that are each mounted at the end of a finger 110 made from an electrically insulating material. Reference A110 denotes the longitudinal axis of a finger 110. As more particularly shown by FIGS. 3 to 5, each electrode 100 is rectilinear and extends along the axis A110 of the finger 110 on which it is mounted. Thus, the axis A110 of a finger 110 extends, toward the rear and from its tip 102, the electrode 100 supports. Each electrode 100 is connected to the high-voltage unit 60 by a power cable 120 that extends inside the corresponding finger 110, along the axis A110. The tip 102 of each electrode 100 exceeds the finger 110 and protrudes outside it, in a basin 112 arranged at the end 114 of the finger 110 opposite the body 30.

Skirt air outlet orifices 36 are provided on the body 30, around the bowl 20, and allow the flow of air jets J for configuring a cloud of droplets G leaving the edge 22 of the bowl 20.

Figure 3:
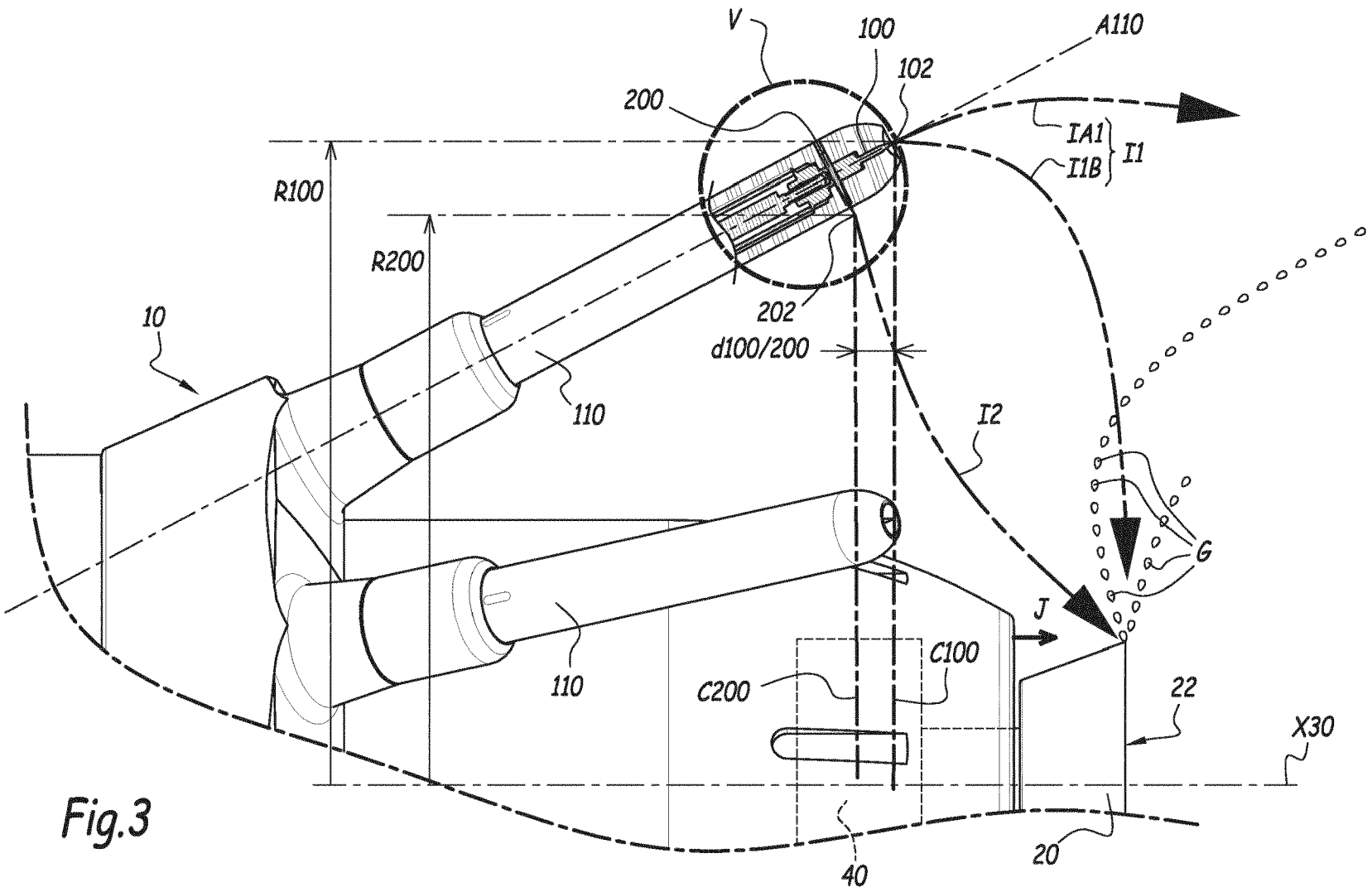
FIG. 3 is an enlarged view of detail III in FIG. 1, when the sprayer is in a first operating configuration, the end of an electrode support being shown in sectional view.

During normal operation, and as shown in FIG. 3, the electrodes 100 are powered by the high-voltage unit 60, for example a negative high voltage comprised between −40 kV and −100 kV, such that the air present around the tips 102 is ionized. An ionization current I is thus created from each tip 102, the intensity of which is generally approximately 50 microamperes (mA) and that comprises a component I1A that flows toward the object O being coated and a component I1B that flows toward the spraying edge 22 of the bowl 20.

As shown in FIG. 3, the droplets G of coating product leaving the edge 22 of the bowl 20 tend to move radially away from this edge, under the effect of the centrifugal force, to the point that they cross the ionization current I1, at its component I1B, or even at its component I1A. As explained above, the droplets G that leave the edge 22 are positively charged by influence, such that they would rather tend to be attracted by the electrodes 100. However, by crossing the negative ions of the current I1, the droplets G change polarity, to the point that they are pushed back by the electrode 100 and follow the electrostatic field that is created by the potential difference between the electrodes 100 and the object O, which is at the ground.

This corresponds to the traditional operation of an external charge electrostatic sprayer, and the electrodes 100 make up first electrodes that emit a stream of ions making up the ionization current I1, at least partially toward the object O to be coated.

The tips 102 of the electrodes 100 are distributed on an imaginary circle C100 that is centered on the axis X30 and perpendicular thereto. Reference R100 denotes the radius of this circle.

Figure 4:
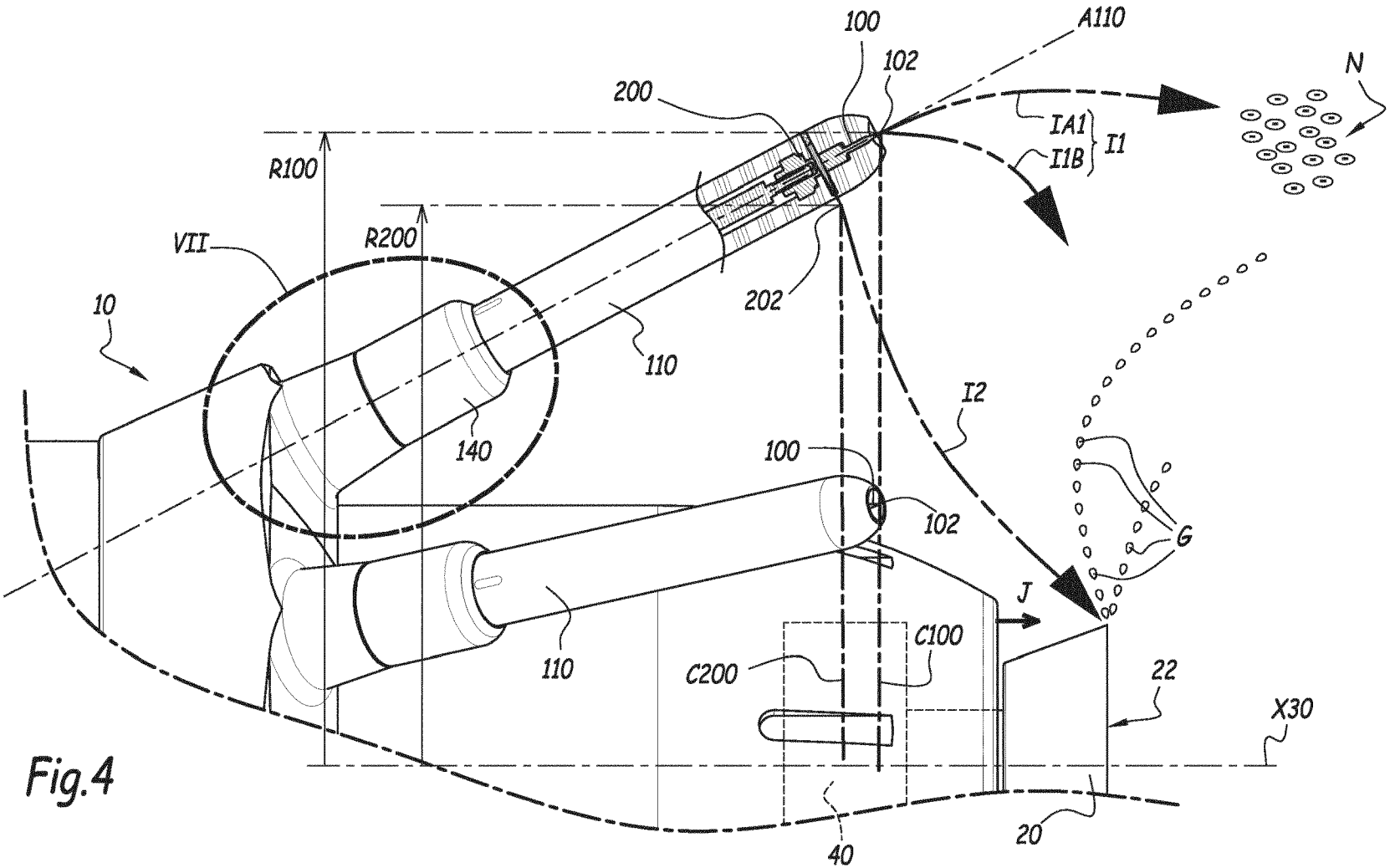
FIG. 4 is a view similar to FIG. 3, when the sprayer is in a second operating configuration.

As shown in FIG. 4, it is possible for a cloud N of droplets that are already negatively charged to be pushed back near an electrode 100, at a distance that may be approximately 3 cm for example, in particular after these droplets have bounced against the object O being coated. In this case, the cloud N acts as a screen between this electrode and the target formed by the object O at the earth potential, the electrostatic field generated at the tip 102 of the electrode 100 decreases and the ionization current I1 emitted by this electrode decreases. Its intensity decreases, for example to 7 mA. The same is true when a quantity of coating product begins to be deposited in the basin 112 that surrounds the tip 102 of this electrode. In this case, the tip 102 of the electrode 100 is lower performing than in the configuration of FIG. 3 to ionize the air and the ionization current I1 may not be sufficient to reverse the polarity of the droplets G that leave the edge 22, to the point that these droplets could be attracted by the electrode 100 and quickly cover the end 114 of the finger 110, in particular on its side turned toward the bowl 20 and in the basin 112.

To avoid this runaway phenomenon of dirtying, each finger 110 is equipped with a second electrode 200 that extends along an axis A200 perpendicular to the axis A110 and the tip 202 of which is oriented toward the edge 22 of the bowl 20. In practice, the axis A200 is oriented toward the bowl, more specifically the edge 22, and the electrode 200 is rectilinear.

A finger 110 therefore constitutes a mechanical support and positioning member, relative to the body 30 and the bowl 20, of an electrode 100 and an electrode 200.

Figure 5:
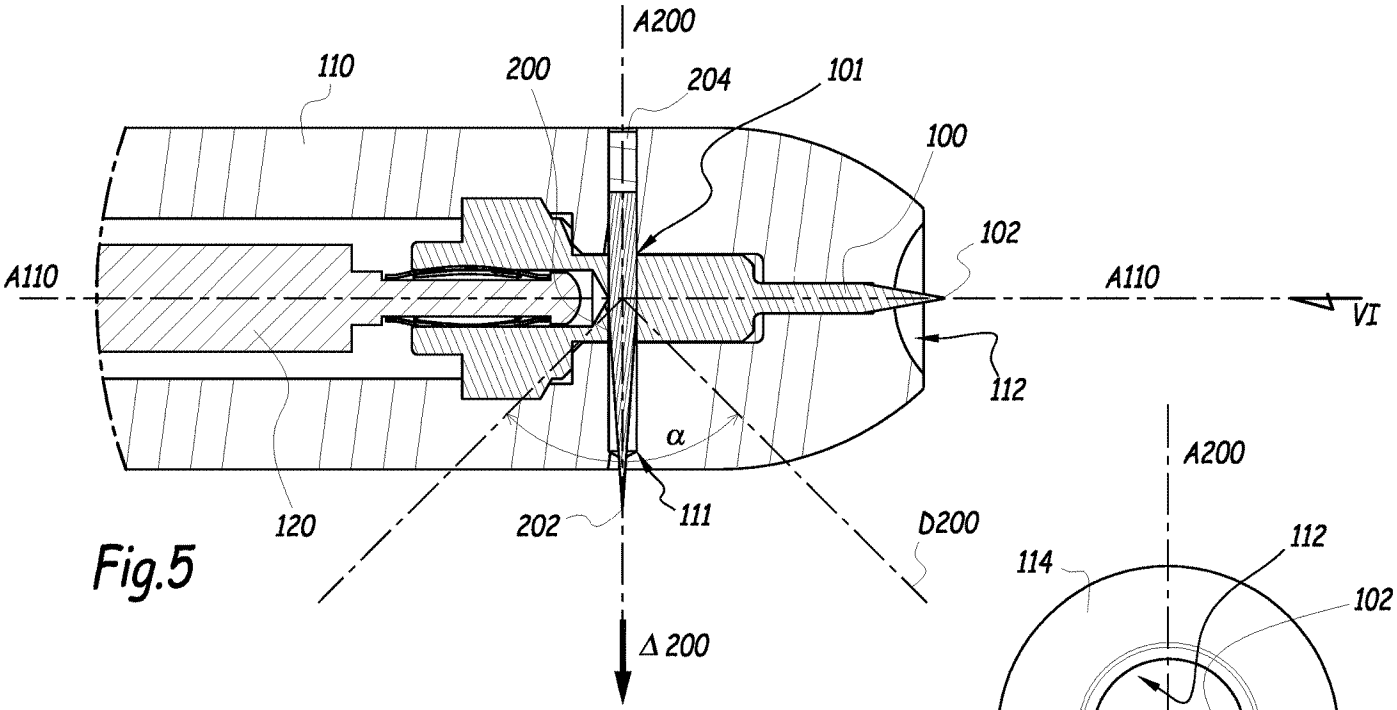
FIG. 5 is a larger scale view of detail V in FIG. 3.

In practice, as emerges from FIG. 5, the electrode 200 is positioned in a transverse orifice 111 of the figure 110 that crosses through the latter along a diameter, while the figure 110 has a circular section. The electrode 200 also crosses through an orifice 101 arranged in the electrode 100, like a pin that immobilizes the electrode 100 in axial translation, along the axis A110, in the FIG. 110. Thus, the electrodes 100 and 200, which are both made from an electrically conductive material such as steel, are in electric contact with one another and brought to the same potential, by the cable 120 connected to the unit 60.

A stopper 204 closes off each orifice 111 opposite the tip 202 of the electrode 200 that it contains. This stopper is made from an electrically insulating material, preferably the same as that of the finger 110.

During operation, and according to a phenomenon similar to that explained regarding the electrodes 100, an ionization phenomenon of the air occurs near the tip 202 of each electrode 200, such that an ionization current I2 develops, this current flowing toward the closest mass, i.e., the edge 22 of the bowl 20. The total intensity of the current emitted by a finger 110 increases by 10 to 20% relative to the traditional configuration. In other words, the sum of the intensities of the currents I1 and I2 emitted from the two tips 102 and 202 supported by this finger is approximately 60 μA.

It will be noted that this ionization current I2 is only slightly disrupted by the potential presence of the obstacle formed by the cloud N of droplets previously negatively charged near the end 114 of the finger 110 or due to the fact that a quantity of paint is deposited in the basin 112 of the finger 110.

In other words, the electrostatic field created between each electrode 200 and the bowl 20 is influenced by the outside conditions less than that created from an electrode 100. The electrostatic field at the second electrodes 200 is said to be less "susceptible" than that at the first electrodes 100. Thus, the ionization phenomenon that occurs from the tips 202 of the electrodes 200 is substantially constant, irrespective of the electrostatic and aeraulic environment of the end 114.

As a result, when the droplets G, which are positively charged, leave the edge 22, they necessarily encounter negative ions coming from the ion current I2, to the point that their polarity is reversed and they become negative. They are therefore necessarily pushed back by the end 114 of a finger 110 that includes two electrodes 100 and 200 at a negative potential, even if the ionization phenomenon due to the tips 102 of the first electrodes 100 is only partial, as indicated above, in the configuration of FIG. 4.

The tips 202 of the second electrodes 200 are distributed on a circle C200 that is centered on the axis X30 and perpendicular thereto, like the circle C100. Reference R200 denotes the radius of the circle C200.

The radii R100 and R200 are different. More specifically, the radius R200 is smaller than the radius R100. In other words, the tips 202 of the electrodes 200 are situated, radially relative to the axis X30, inside the tips 102 of the electrodes 100.

In the plane of FIGS. 1, 3 and 4 or in the plane of FIG. 5, which is a radial plane relative to the axis X30, the circles C100 and C200 are offset along the axis X30 by a non-zero distance d100/200. More specifically, the circle C200 is positioned behind the circle C100. In other words, the electrodes 200 are further from the object O being coated than the electrodes 100. Thus, the ionization current I2 and the electrostatic field between the tips 202 and the edge 22 are less subject to the disruptions than the current I1 and the electrostatic field whereof the tips 102 are the origin.

Figure 6:
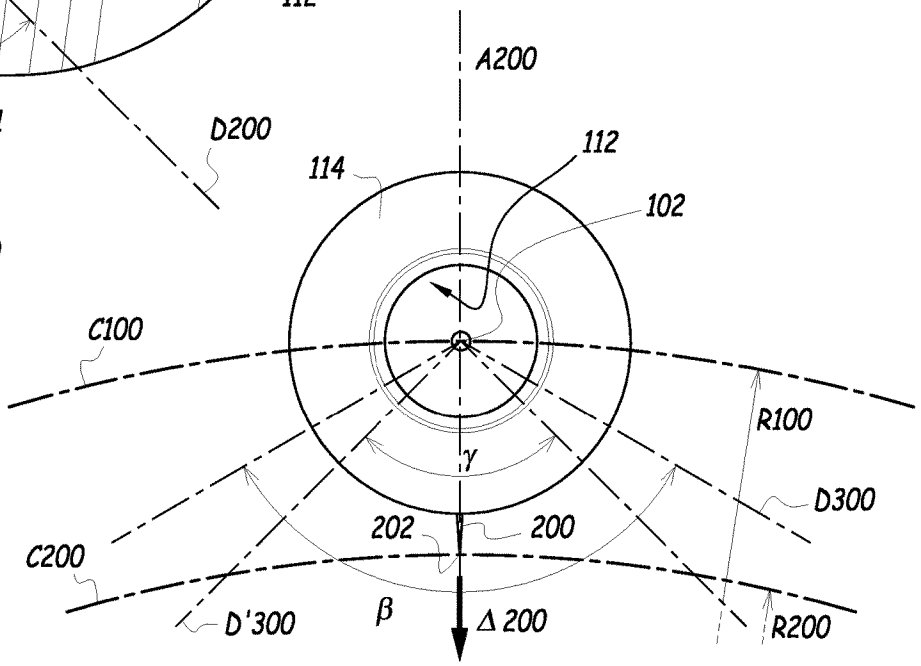
FIG. 6 is an end view of an electrode support, in the direction of arrow VI in FIG. 5.

In the plane of FIG. 5, which is radial relative to the axis X30, the electrode 200 extends along the axis A200, which is perpendicular to the axis A110, and in a direction Δ200 that is oriented toward the edge 22 of the bowl 20. An imaginary dihedron D200 is considered with $\alpha=90°$ and that is centered on the point of intersection between the axes A110 and A200. In practice, the tips 202 of an electrode 200 can be situated, in the plane of FIG. 5, inside the dihedron D200, while being effective to generate an electrostatic field and a constant ion current toward the edge 22, even if the direction Δ200 does not strictly target the edge 22. In the plane of FIG. 6, an imaginary dihedron D300 is considered centered on the axis A200 whereof the apex is formed by the outline of the axis A110, i.e., the projection of the tip 102, and whereof the apical angle $\gamma$ is equal to 120°. In the plane of FIG. 6, the projection of the axis A200 is radial relative to the axis X30. The tip 202 of an electrode 200 is situated, in the plane of FIG. 6, outside the dihedron D300. Preferably, the tip 202 of an electrode 200 is positioned, in the plane of FIG. 6, inside the dihedron D'300 with the same apex as the dihedron D300, also centered on the axis A200 and the apical angle $\gamma$ of which is equal to 90°. Thus, the tip 202 of a second electrode 200 can be situated, relative to the figure 110 on which it is mounted, in an ellipse-shaped or cone trunk-shaped volume that is centered on the axis A200 and diverge toward the edge 22.

It will be understood that the effectiveness of the second electrodes 200 is reinforced by the fact that their tips 202 are oriented globally toward the bowl 20. One should therefore ensure proper positioning of each of these electrodes in a radial direction relative to the axis A110 of the finger 110 on which is mounted.

Yet it is sometimes necessary to disassemble the fingers 110 from the sprayer 10 for maintenance operations. The mounting of each of the fingers 110 on the body 30 inches a satisfactory orientation owing to indexing means of each finger 110 in rotation around its axis A110.

Figure 7:
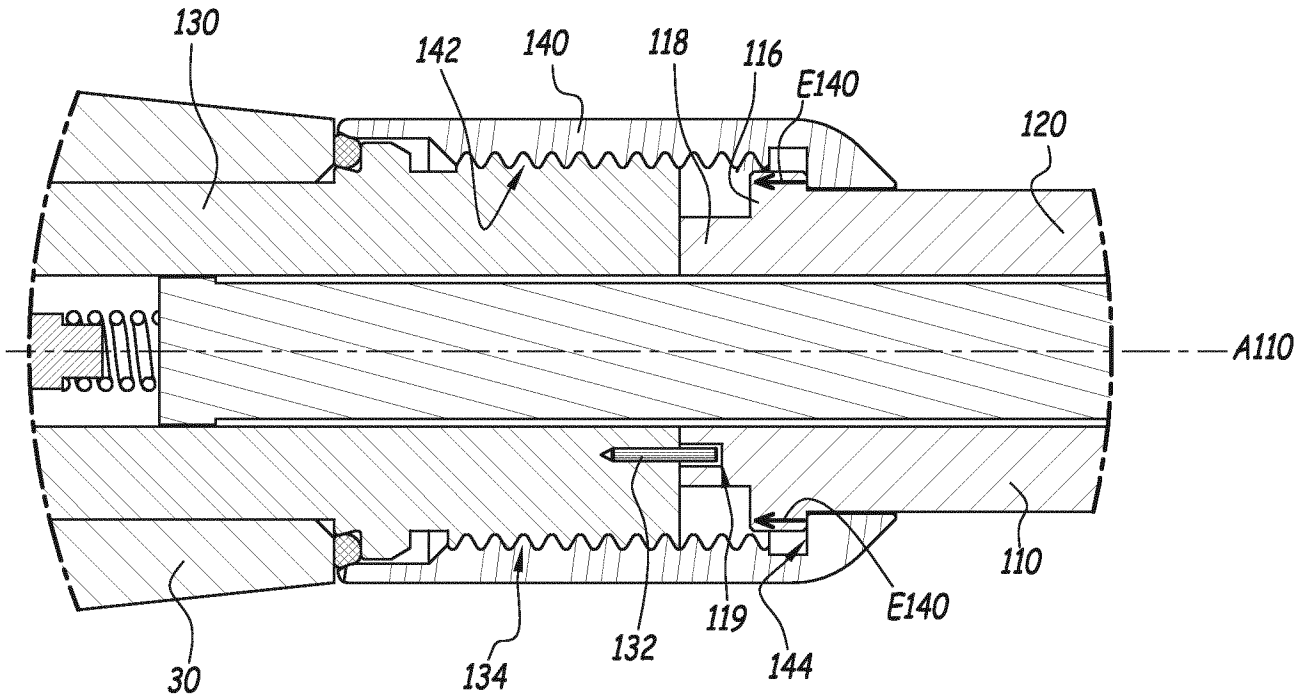
FIG. 7 is an enlarged longitudinal sectional view of an electrode support finger, in zone VII in FIG. 4.

As shown in FIG. 7, each finger 110 comprises a collar 116 that extends radially outward, while its second end 118, opposite the end 114 that bears the basin 112, is provided with a blind housing 119. Furthermore, a base 130 is immobilized on the body 30 and this base is equipped with a slug 132 designed to be engaged in the blind housing 119 of the finger 110 when this finger is mounted on the body 30. A nut 140 is provided with an inner thread 142 and an inner shoulder 144 that are respectively designed to engage with an outer tapping 134 of the base 130 and with the collar 116, so as to exert, on the end 118, a force E140 oriented parallel to the axis A110 and that presses the end 118 against the base 130, when the nut 140 is screwed on that base. In this configuration, the slug 132 is locked in the housing 119 and prevents an untimely rotation of the finger 110 around its axis A110. The slug 132 and the housing 119 therefore make it possible to index the finger 110 in rotation around the axis A110, in a position where the electrode 200 is actually turned toward the bowl 20.

Figure 8:
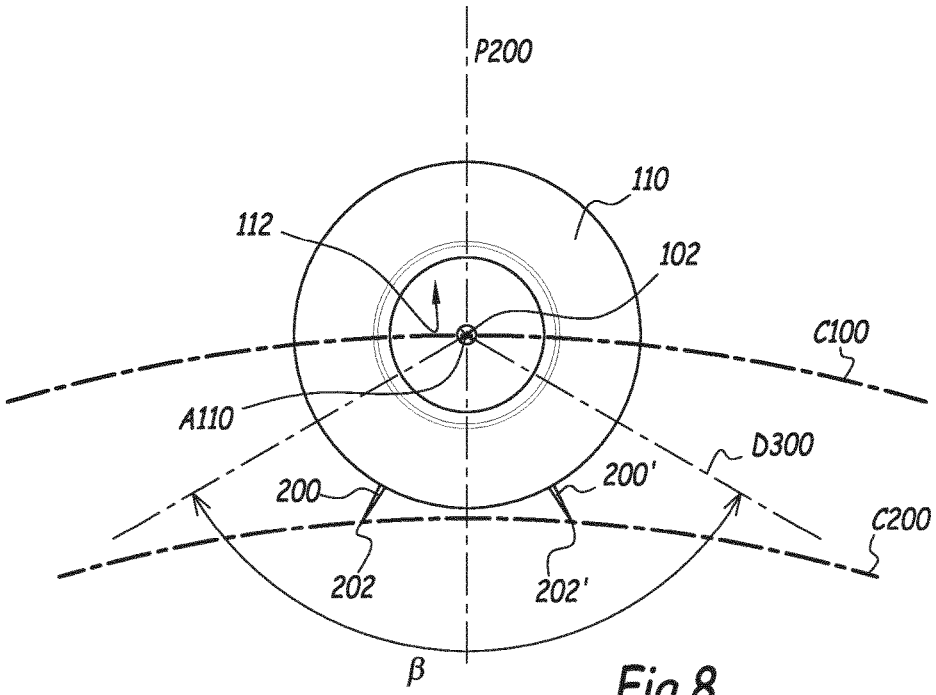
FIG. 8 is an end view similar to FIG. 6 for a sprayer according to a second embodiment.
Figure 9:
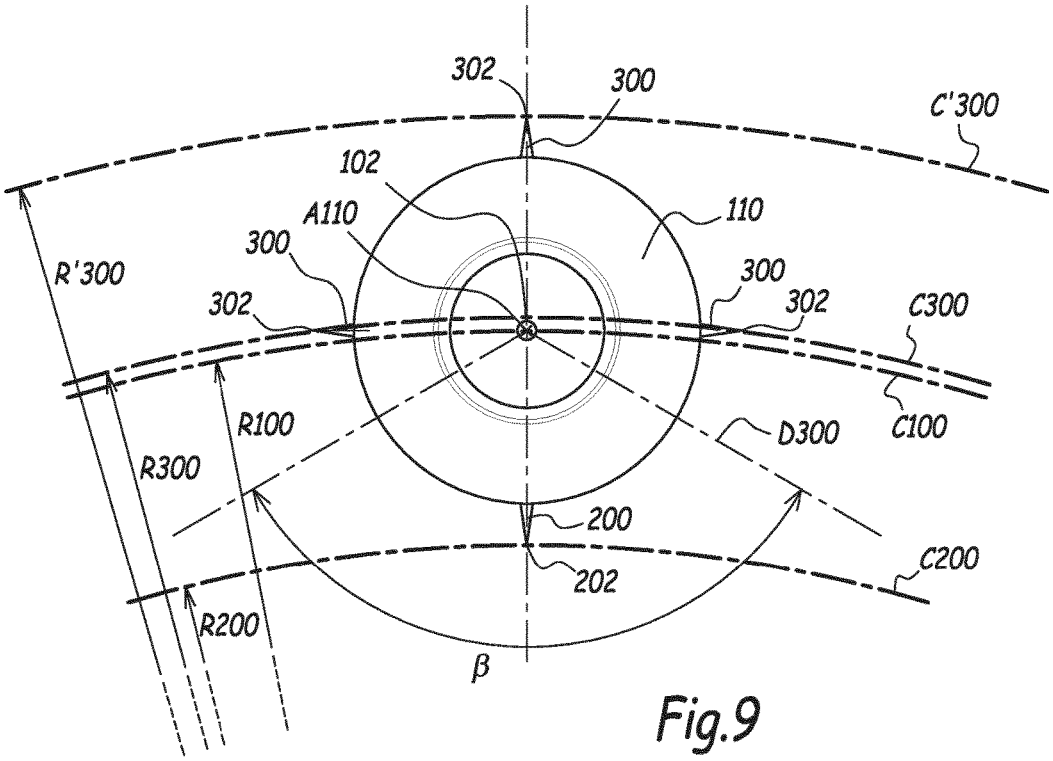
FIG. 9 is a view similar to FIG. 6 for a sprayer according to a third embodiment of the invention.
Figure 10:
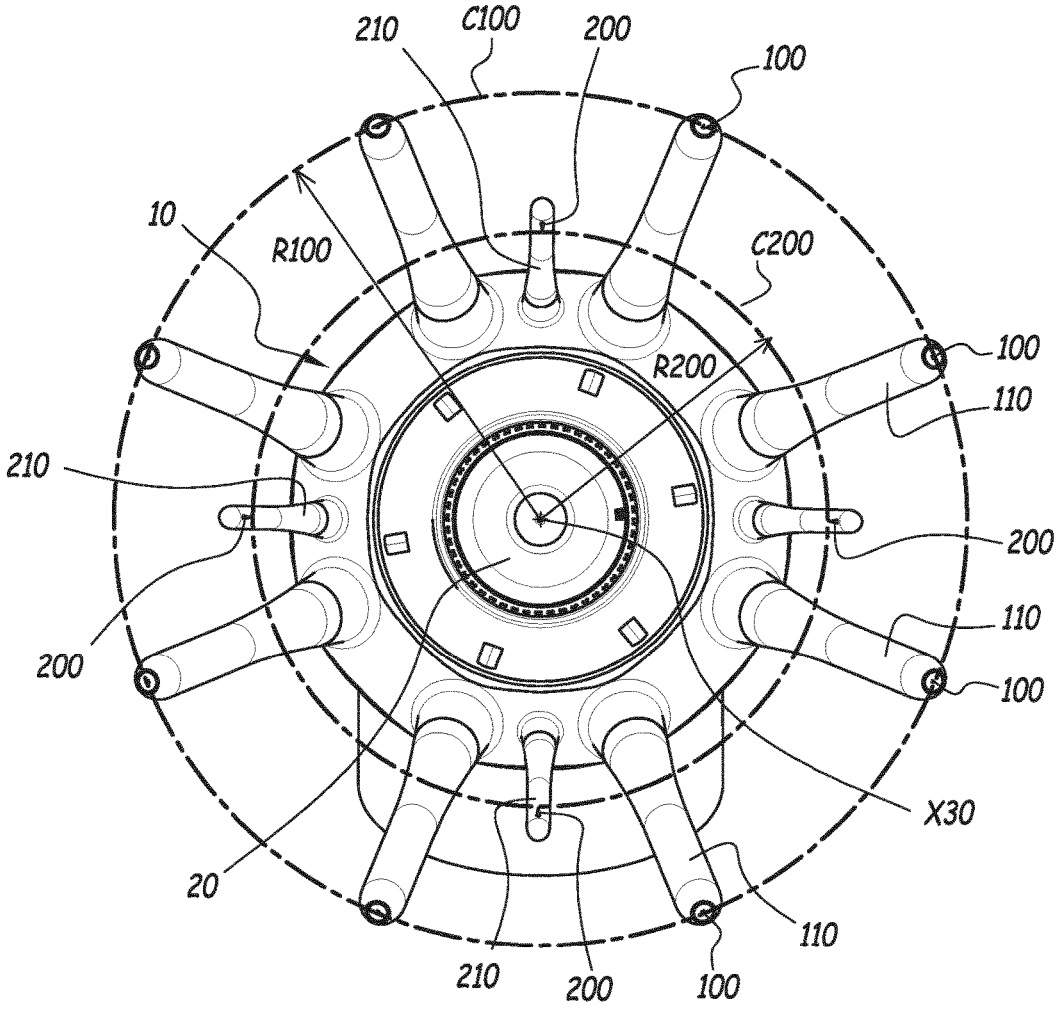
FIG. 10 is a view similar to FIG. 2 for a sprayer according to a fourth embodiment of the invention.

In the second to fourth embodiments of the invention illustrated in FIGS. 8 to 10, the elements similar to those of the first embodiment bear the same references. In the following, we describe how these embodiments differ from the first.

In the second embodiment, each finger 110 is equipped, near an electrode 100, with two electrodes 200 and 200' that are similar to the electrode 200 of the first embodiment and the tips 202 and 202' of which are positioned, systematically relative to a plane P200 that is radial with respect to the axis X30 and containing the axis A110, inside a dihedron D300 defined as in the first embodiment.

In the third embodiment shown in FIG. 9, the finger 110 is equipped with a first electrode 100 whereof the tip 102 is visible in this figure, as well as a second electrode 200 whereof the tip 202 is also visible and that extends in a dihedron D300 defined as in the first embodiment. This finger 100 is also equipped with three electrodes 300, the tips 302 of which are situated radially outside the circle C100 and that are distributed on two circles C300 and C'300 whereof the radii R300 and R'300 are larger than the radius R100 defined as in the first embodiment. The circles C300 and C'300 are centered on the axis X30 and perpendicular thereto.

The electrodes C300 are used to push back the droplets of coating product that could come back toward the surface of the part 110 turned opposite the bowl 20, in particular due to movements of the sprayer 10 within a cloud of droplets being sprayed toward an object O.

In the first three embodiments, the second electrodes 200 and optionally 200', or even the third electrodes 300, are supported by the fingers 110, which also support the first electrodes 100.

In the fourth embodiment, the electrodes 100 are supported by fingers 110, while the electrodes 200 are supported by fingers 210 separate from the fingers 100. This makes it possible to position the electrodes 200 independently of the electrodes 100, and if applicable, to have a number of electrodes 200 different from the number of electrodes 100 as in the example of FIG. 10, where only four fingers 210 are provided, while eight fingers 110 are used. Alternatively, in this embodiment, eight fingers 210 can be used, the fingers 210 then alternating regularly with the fingers 110.

The invention has been described above in the case of a sprayer for a liquid coating product. It is also applicable to an externally charged rotating electrostatic sprayer for a powdered spraying product.

The technical features of the embodiments and alternatives considered above may be combined.

The invention claimed is:

1. An electrostatic sprayer coating products with an external charge, comprising:

a bowl rotating around a rotation axis, means for driving the rotation of the bowl around the rotation axis, several first charge electrodes distributed around the rotation axis and each configured to emit, when the sprayer is operating and at least partially toward an object to be coated, a first stream of ions from a first tip, the first tips being fitted into a first circle centered on the rotation axis and perpendicular thereto, and several second charge electrodes each configured to emit, when the sprayer is operating and primarily or exclusively toward a grounded edge of the bowl, a second stream of ions, with the same sign as the ions of the first ion streams, from second tips fitted into a second circle centered on the rotation axis, perpendicular thereto and the radius of which being different from that of the first circle, wherein each second charge electrode extends in a direction that is oriented towards the grounded edge of the bowl, wherein each second tip is positioned, in a plane radial to the rotation axis, in a dihedron whereof the origin is on an axis extending one of said several first charge electrodes toward the rear, the apical angle of which is equal to 90° and which is centered on an axis oriented toward the grounded edge of the bowl, wherein the radius of the second circle is smaller than the radius of the first circle, and wherein the second tips are offset, along the rotation axis and toward the rear of the sprayer, relative to the first tips.

2. The sprayer according to claim 1, wherein each second tip is oriented globally toward the grounded edge of the bowl.

3. The sprayer according to claim 1, wherein each second tip is positioned, in a plane transverse to the axis of rotation, in a dihedron whereof the origin is combined with the projection of the tip of one of said several first charge electrode, the apical angle of which is equal to 120°, and which is centered on a radial axis relative to the rotation axis.

4. The sprayer according to claim 3, wherein:

in a plane radial to the rotation axis, each second tip is positioned on the central axis of the dihedron in which it is positioned, and in a plane transverse to the rotation axis, each second tip is positioned on the central radial axis of the dihedron in which it is positioned.

5. The sprayer according to claim 1, further comprising several supports each bearing one of the first electrodes and at least one second charge electrode.

6. The sprayer according to claim 5, wherein the electrodes are rectilinear, the first charge electrode of each support extending along a longitudinal axis of the support and the second charge electrode of each support extending along an axis perpendicular to the longitudinal axis.

7. The sprayer according to claim 5, further comprising means for indexing the position of each support in rotation around its longitudinal axis.

8. The sprayer according to claim 1, wherein a single second charge electrode is in the vicinity of each first charge electrode, in particular on a same support.

9. The sprayer according to claim 1, wherein several second charge electrodes are in the vicinity of each first charge electrode.

10. The sprayer according to claim 1, further comprising third electrodes provided with third tips fitted into a third circle centered on the rotation axis and perpendicular thereto, the radius of which is different from those of the first and second circles, these third tips being oriented radially outward relative to the rotation axis.

11. A facility for spraying the coating product, further comprising at least one sprayer according to claim 1.

12. The sprayer according to claim 1, wherein the first circle and the second circle are offset, along the rotation axis and toward the rear of the sprayer, relative to the grounded edge of the bowl.

13. The sprayer according to claim 1, wherein the first stream of ions comprises a first component that flows towards the object being coated and a second component that flows towards the grounded edge of the bowl.

14. The sprayer according to claim 1, wherein each second tip is positioned, in a plane transverse to the axis of rotation, in a dihedron whereof the origin is combined with the projection of the tip of one of said several first charge electrode, the apical angle of which is equal to 90°, and which is centered on a radial axis relative to the rotation axis.

15. The sprayer according to claim 1, wherein a single second charge electrode is in the vicinity of each first charge electrode on a same support.

16. The sprayer according to claim 1, wherein several second charge electrodes are in the vicinity of each first charge electrode on a same support.

* * * * *